United States Patent [19]

Higuchi

[11] 4,156,581

[45] May 29, 1979

[54] CENTRIFUGAL COMPRESSOR FOR A GAS TURBINE

[75] Inventor: Shinichiro Higuchi, Susono, Japan

[73] Assignee: Toyota Jidosha Kogyo Kabushiki Kaisha, Aichi, Japan

[21] Appl. No.: 834,067

[22] Filed: Sep. 16, 1977

[30] Foreign Application Priority Data

May 6, 1977 [JP] Japan ..... 52-52382

[51] Int. Cl.[2] ..... F04D 29/22; F04D 29/44; F04D 29/66

[52] U.S. Cl. ..... 415/169 R; 415/DIG. 1; 415/213 R

[58] Field of Search ..... 415/207, 211, DIG. 1, 415/169 R, 110, 111, 219 A, 219 C, 213 R; 416/185

[56] References Cited

U.S. PATENT DOCUMENTS

| | | | |
|---|---|---|---|
| 2,681,760 | 6/1954 | Lundquist | 415/211 |
| 3,771,925 | 11/1973 | Friberg et al. | 415/211 X |
| 3,904,312 | 9/1975 | Exley | 415/211 X |
| 4,063,848 | 12/1977 | Wiggins et al. | 415/211 X |

FOREIGN PATENT DOCUMENTS

| | | | |
|---|---|---|---|
| 1188110 | 3/1959 | France | 415/219 A |
| 360205 | 6/1938 | Italy | 415/DIG. 1 |
| 50-138410 | 11/1975 | Japan | 415/111 |

*Primary Examiner*—Carlton R. Croyle
*Assistant Examiner*—Donald S. Holland
*Attorney, Agent, or Firm*—Stevens, Davis, Miller & Mosher

[57] ABSTRACT

A centrifugal compressor for a small-sized gas turbine utilized in an automobile. In a general gas turbine having a centrifugal compressor, a primary air flow along the front surface of a rotor disc is joined by a secondary air flow from a space between the rear surface of the rotor disc and a partition wall in an engine casing. The present invention provides improved positional relationships between the forward end of the outer periphery of a rotor disc and the rear wall of a diffuser, the outer periphery of the rotor disc and the tip of a rotor blade and the shape of the rear surface of the outer periphery of the rotor disc and the shape of the wall of a partition wall in an engine casing being opposed thereto, and a combination of those relationships to prevent the secondary air flow from changing the direction of the primary air flow.

1 Claim, 3 Drawing Figures

CENTRIFUGAL COMPRESSOR FOR A GAS TURBINE

BACKGROUND OF THE INVENTION

In a general gas turbine having a centrifugal compressor, the flow of air introduced into the turbine is accelerated by a rotor of the centrifugal compressor, and moves into a combustion chamber via a diffuser and a heat exchanger. In the combustion chamber, part of the air is converted into combustion gas by facilitating combustion of fuel. Then the combustion gas flows into a turbine room with the remainder of the air to rotate the turbine and the centrifugal compressor at high speed, and is thereafter discharged into the environment through an exhaust pipe. Part of the combustion gas flows via a space between the shaft of the centrifugal compressor and an engine casing into a space between the rotor disc of the centrifugal compressor and a partition wall in the engine casing, to flow behind the rotor disc as a secondary air flow. The secondary air flow joins the primary air flow from the rotor blade at the outer periphery of the rotor disc.

In a conventional large-sized gas turbine having a centrifugal compressor utilized in locomotives, ships and airplanes, the secondary air flow offers no problem to the efficiency of the centrifugal compressor since the secondary air flow is relatively small in comparison with the primary air flow and does not cause change of direction, or pressure loss in the primary air flow.

However, in a small-sized gas turbine having a centrifugal compressor utilized in an automobile, the secondary air flow causes change of direction and pressure loss in the primary air flow since the secondary air flow is relatively large in rate in comparison with the primary air flow. This is because the tip of the rotor blade is positioned on the same level with the outer periphery of the rotor disc. Namely, the secondary air flow joins the primary air flow at the portion right behind the tip of the rotor blade and increases the velocity and frictional loss of the primary air flow. Further, since the secondary air flow joins the primary air flow substantially at a right angle thereto, it changes the direction of the primary air flow and creates mixing, and the pressure loss of the primary air is increased.

As hereinabove described, the primary air flow does not have its direction changed by the secondary air flow when the secondary air flow is relatively small in comparison with the primary air flow, while the direction of the primary air flow is largely changed when the secondary air flow is relatively large. Consequently, the direction of the primary air flow deviates from a predetermined optimum inlet angle of the diffuser, resulting in an increase of pressure loss in the diffuser. The secondary air flow which is large in rate increases the velocity of the primary air flow to increase the frictional loss of the diffuser, and causes pressure loss by mixing with the primary air flow. Further, it lowers the efficiency of the gas turbine by moving the working area of the primary air flow.

SUMMARY OF THE INVENTION

The object of the present invention is to overcome the aforementioned disadvantages of a small-sized gas turbine by providing improved positional relationships between the forward end of the outer periphery of a rotor disc and the rear wall of a diffuser, the outer periphery of the rotor disc and the tip of a rotor blade and the shape of the rear surface of the outer periphery of the rotor disc and the shape of the wall of a partition wall in an engine casing being opposed thereto, and a combination of those relationships.

BRIEF DESCRIPTION OF THE DRAWINGS

The invention will now be described in further detail by way of example with reference to the accompanying drawings, in which.

DETAILED DESCRIPTION OF THE PREFERRED EMBODIMENT

Figure 1:
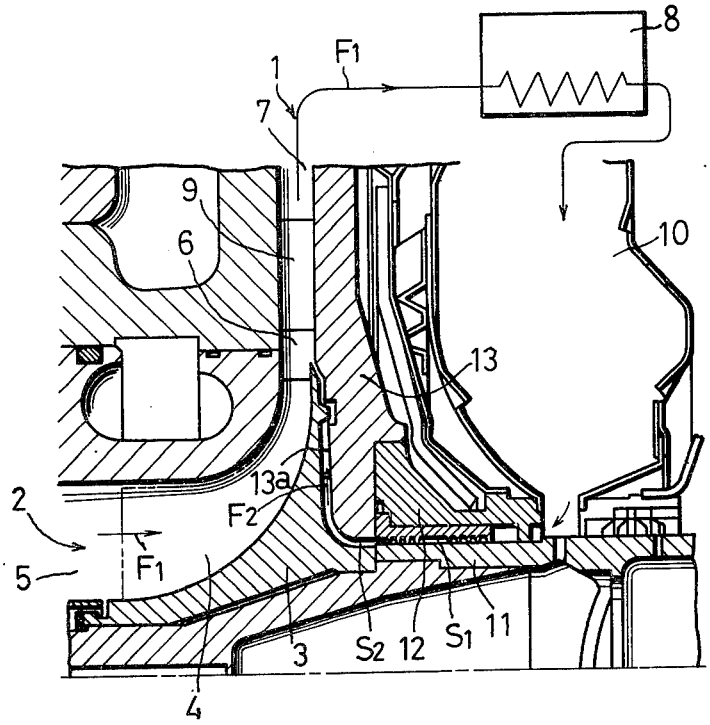
FIG. 1 is a longitudinal sectional view of a gas turbine in which the centrifugal compressor of the present invention is applied.
Figure 2:
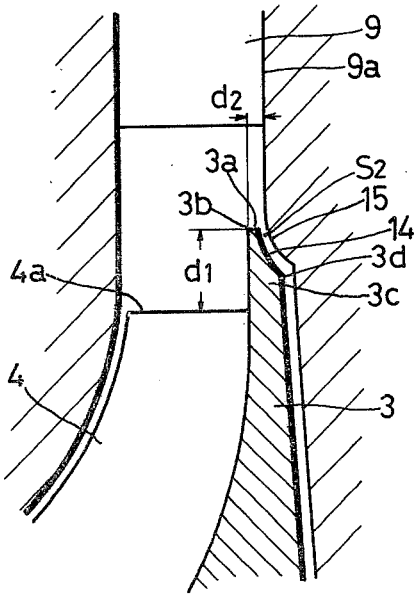
FIG. 2 is a partially enlarged view of FIG. 1.

Referring now to FIGS. 1 and 2 of the drawings, there is shown a gas turbine 1 comprising a centrifugal compressor 2, a rotor disc 3 thereof and a rotor blade 4 mounted integrally to the front surface of the rotor disc 3. The rotor blade 4 is positioned below the rotor disc 3 keeping a distance $d_1$ between the tip 4*a* of the rotor blade 4 and the outer periphery 3*a* of the rotor disc 3. Numerals 5 and 6 show the inlet and outlet of the rotor section, respectively. The outlet 6 is connected with a heat exchanger 8 by an air passage 7 provided with a ring-shaped diffuser 9 having a cross section extending in the direction of air flow. Numerals 10, 11 and 12 show a combustion chamber, a shaft for the rotor disc 3 and an engine casing respectively, and a space $S_1$ is defined between the shaft 11 and the engine casing 12. A partition wall 13 is provided in the engine casing 12 behind the rotor disc 3 to define a space $S_2$ between the front surface 13*a* thereof and the rear surface 3*d* of the rotor disc 3 so as to divide the combustion chamber 10 from the air passage 7. The space $S_2$ communicates with the space $S_1$.

The front end 3*b* of the outer periphery 3*a* of the rotor disc 3 is offset at a distance $d_2$ from the rear wall 9*a* of the diffuser 9, which joins the front surface 13*a* of the partition wall 13 in FIGS. 1 and 2. In the rear surface 3*d* of the outer portion 3*c* of the rotor disc 3, there is provided a ring-shaped recess 14 which tapers the rotor disc 3 in proportion to the increase in length thereof in the radial direction. In the partition wall 13 opposite to the recess 14, there is provided a ring-shaped bulging 15 which is complementary to the recess 14 in shape.

In operation, air flows into the centrifugal compressor 2 through the inlet 5, and the air flow is accelerated by the rotor blade 4, and introduced into the combustion chamber 10 through the outlet 6, diffuser 9, air passage 7 and the heat exchanger 8 as a primary air flow indicated by an arrow $F_1$ in FIG. 1. Part of the air is converted into combustion gas by facilitating combustion of fuel therein, and most of the mixture of the combustion gas and the remainder of the air is discharged into the environment through an exhaust pipe (not shown) after it rotates a turbine (not shown). The residue of the mixture flows into the space $S_2$ provided between the rotor disc 3 and the partition wall 13 via the space $S_1$ provided between the shaft 11 and the engine casing 12 as a secondary air flow indicated by an arrow $F_2$ in FIG. 1, and flows back to the outlet 6 through the outer periphery 3*a* of the rotor disc 3 to join the primary air flow indicated by the arrow $F_1$.

As hereinabove described, the front end 3b of the outer periphery 3a of the rotor disc 3 is offset at the distance $d_2$ from the rear wall 9a of the diffuser 9 to provide sufficient width for the passage of the primary air flow $F_1$. Therefore, the primary air flow $F_1$ is prevented from getting pressure and frictional losses caused by a difference in the directions of air flow.

Since the tip 4a of the rotor blade 4 is lower than the outer periphery 3a of the rotor disc 3, the primary air flow $F_1$ is not affected by the secondary air flow $F_2$, and frictional loss in the primary air flow $F_1$ is largely decreased.

Further, since the ring-shaped recess 14 and the ring-shaped bulging 15 are provided in the rear surface 3d of the outer portion 3c of the rotor disc 3 and in the partition wall 13 of the engine casing 12 respectively, the secondary air flow $F_2$ joins the primary air flow $F_1$ at an angle smaller than that in a conventional centrifugal compressor. Thus, pressure loss in the primary air flow $F_1$ is largely decreased.

Figure 3:
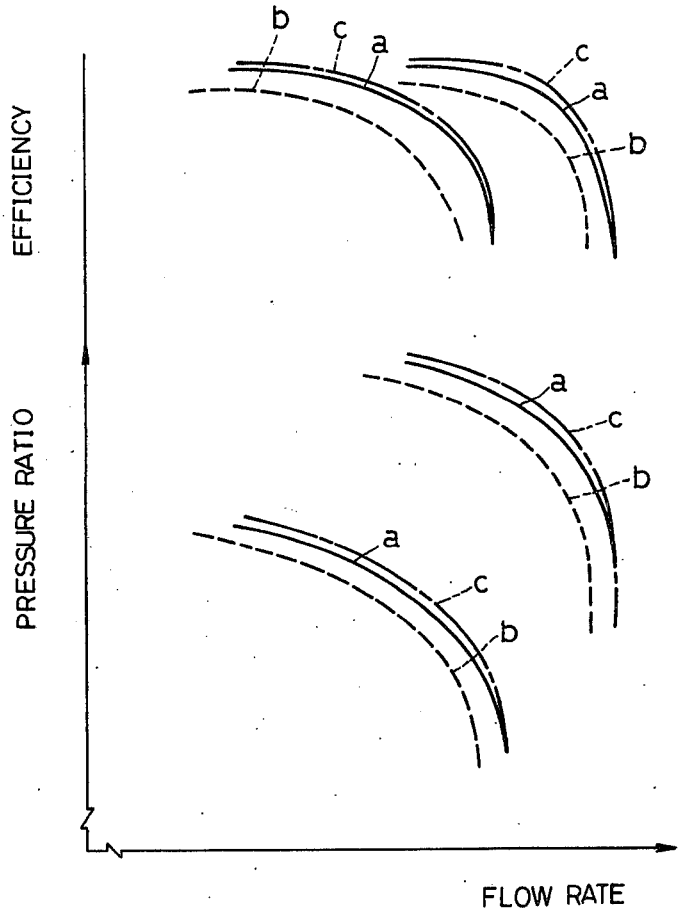
FIG. 3 is a graph showing the advantages of the present invention in comparison with the prior arts.

FIG. 3 is a graph showing the characteristics (pressure ratio and efficiency against the flow rate of air) of the preferred embodiment of the present invention indicated by curve a in comparison with a conventional centrifugal compressor with secondary air flow indicated by curve b and another conventional centrifugal compressor without secondary air flow indicated by curve c, from which it will be noted that the present invention is superior to the prior art. In the graph of FIG. 3, the highest level is shown by the conventional centrifugal compressor without secondary air flow indicated by c. However, in this type of centrifugal compressor, it is necessary to complete sealing between the shaft and the engine casing, which leads to a increase of frictional loss in the shaft and a decrease in durability of the sealing device.

While the invention has been described with reference to a preferred embodiment thereof, it is to be understood that modifications or variations may be easily made without departing from the scope of this invention which is defined by the appended claims.

What is claimed is:

1. A centrifugal compressor for a gas turbine, said compressor comprising:

a diffuser having a rear wall;

a rotor disc having an outer periphery with a front end offset from the rear wall of the diffuser, said disc also having an outer portion with a rear surface;

a rotor blade having a tip positioned radially inwardly of the outer periphery of said rotor disc;

a ring-shaped recess in the rear surface of the outer portion of said rotor disc to taper said rotor disc in proportion to the increase in length thereof in the radial direction;

an engine casing having a partition wall opposite to said recess; and a ring-shaped bulging in the partition wall of the engine casing opposite to said recess to be complementary to said recess in shape.

* * * * *